United States Patent [19]

Nelson et al.

[11] 4,215,258

[45] Jul. 29, 1980

[54] MICROWAVE OVEN WINDOW CONSTRUCTION

[75] Inventors: Alfred D. Nelson, Stillwater; Merlin R. Jahnke, Woodbury, both of Minn.

[73] Assignee: Minnesota Mining and Manufacturing Company, St. Paul, Minn.

[21] Appl. No.: 859,117

[22] Filed: Dec. 9, 1977

Related U.S. Application Data

[63] Continuation-in-part of Ser. No. 758,121, Jan. 10, 1977, abandoned.

[51] Int. Cl.[2] ..... H05B 6/64

[52] U.S. Cl. ..... 219/10.55 D; 126/200; 174/35 MS

[58] Field of Search ..... 219/10.55 D, 10.55 R, 219/10.55 F; 174/35 R, 35 GC, 35 MS, 25 R; 126/200

[56] References Cited

U.S. PATENT DOCUMENTS

| | | | |
|---|---|---|---|
| Re. 24,906 | 12/1960 | Ulrich | 427/208 |
| Re. 27,823 | 11/1973 | Cox | 174/25 R X |
| 2,920,174 | 1/1960 | Haagensen | 219/10.55 D |
| 2,958,754 | 1/1960 | Hahn | 219/10.55 D |
| 3,304,401 | 2/1967 | Long | 219/10.55 D |
| 3,431,348 | 3/1969 | Nellis, et al. | 219/10.55 D |
| 3,843,859 | 10/1974 | Klemp et al. | 219/10.55 D |
| 4,008,383 | 2/1977 | Tanaka et al. | 219/10.55 D |

*Primary Examiner*—Arthur T. Grimley

[57] ABSTRACT

Microwave oven window comprising two transparent panels, an intermediate microwave-blocking screen and a transparent thermoplastic adhesive filling the space between the panels. The interior panel is very thin and the thickness of the thermoplastic adhesive panel barely exceeds that of the screen. The thinness of the interior panel plus adjacent adhesive minimizes the leakage of microwaves.

8 Claims, 3 Drawing Figures

MICROWAVE OVEN WINDOW CONSTRUCTION

CROSS REFERENCE TO RELATED APPLICATION

This application is a continuation-in-part of applicants' copending application Ser. No. 758,121, filed Jan. 10, 1977 now abandoned.

BACKGROUND OF THE INVENTION

A typical microwave oven door has a metal frame comprising a microwave-blocking screen sandwiched between a pair of transparent panels. As shown in FIG. 3 of U.S. Pat. No. 3,843,859, the exterior transparent panel may be glass and the interior panel may be a relatively thin plastic film such as a polycarbonate film. A pair of epoxy adhesive layers bond the screen to the glass panel and, in turn, the polycarbonate film to the screen. According to column 3, lines 8–12, the adhesive layers can either be coextensive with the screen or only extend around the border. Most microwave oven windows being produced today employ a pair of pressure-sensitive adhesive layers around the border. A few employ mechanical fasteners such as shown in U.S. Pat. No. 3,731,035.

When the interior panel of the window is plastic, it tends to transmit water vapor into the air space between the panels, eventually producing a cloudiness and possibly corroding the microwave-blocking screen. In use, the plastic panel may warp and buckle, further reducing visibility through the window. Since the microwave-blocking screen initially reduces visibility to a near minimum, any significant additional reduction in visibility can require replacement of the window.

A microwave oven window which has no air space at the microwave-blocking screen is disclosed in U.S. Pat. No. 3,431,348. The screen is embedded in silicone resin to provide an elastic inner lamina which is sandwiched between a pair of relatively rigid outer laminae such as glass or acrylic resin sheets. The silicone resin of the inner lamina may be incompletely cured and then further cured in contact with the outer laminae, or the three laminae may be bonded together by separate adhesive layers. The screen extends beyond the composite formed by the three laminae to permit it to make electrically conductive contact with a knitted wire shielding member at the periphery of the window.

We are not aware of any commercialization of the U.S. Pat. No. 3,431,348 construction. The microwave oven windows which we have seen do not provide for electrical contact between the microwave-blocking screen and a separate shielding member. Typically, the microwave-blocking screen and the exterior and interior transparent panels are coextensive, and a microwave-blocking gasket is positioned at the perimeter of the microwave-blocking screen to intercept microwaves escaping around the screen. Often the gasket also serves as a microwave-blocking seal between the oven door and its frame.

THE PRESENT INVENTION

Like windows of the prior art, the microwave oven window of the present invention comprises a pair of transparent panels adhesively bonded to an intermediate microwave-blocking screen. Like the window of U.S. Pat. No. 3,431,348 the novel window substantially eliminates any air space at the microwave-blocking screen and hence retains its initial degree of transparency almost indefinitely. Unlike the window of U.S. Pat. No. 3,431,348, the transparent panels and microwave-blocking screen are coextensive, and the air space is eliminated by a thermoplastic adhesive, preferably a pressure-sensitive adhesive because pressure-sensitive adhesives tend to disperse any entrapped air. The thermoplastic adhesive in thin film form should have zero creep at 65° C., remain transparent after prolonged exposure to heat, light and microwave radiation and have a viscosity at 175° C. of less than two million centipoises. It substantially completely fills the space between the panels including the openings in the screen so that the window is substantially void-free and hence transparent except to the extent of the masking effect of the screen.

The two transparent panels should be separated by little more than the thickness of the microwave-blocking screen. A distance between the two transparent panels of 0.01 mm more than the thickness of the screen is normally sufficient to insure substantial elimination of voids in the thermoplastic adhesive whereas there is no advantage to distances greater than 0.2 mm more than the thickness of the screen. Within that 0.01 to 0.2 mm range, reasonable optical flatness is readily achieved.

The support which the thermoplastic adhesive affords to the interior transparent panel permits it to be weaker and thus thinner than are prior transparent panels which function as structural members. Transparent panels may be from 0.02 to 0.25 mm in thickness whereas somewhat greater thickness has typified the prior art. The thinness of the interior panel plus adjacent adhesive constricts the microwave-transmitting path between the microwave-blocking screen and microwave-blocking members adjacent the window to minimize microwave leakage.

Preferred transparent, thermoplastic adhesives are the acrylic pressure-sensitive adhesives disclosed in U.S. Pat. No. Re. 24,906. Those acrylic adhesives remain highly transparent and unchanged in other properties indefinitely in spite of prolonged exposure to heat, light and microwave radiation. Many of those acrylic adhesives will flow sufficiently under moderate pressure at ordinary room temperature to fill completely the openings of microwave-blocking screen and the spaces between the screen and the transparent panels. However, production rates are enhanced by moderate heating of the adhesive during assembly, e.g., to a temperature in the range of 75°–175° C. If the interior transparent panel is a plastic film, it might be damaged by substantially higher temperatures.

Also useful are other transparent thermoplastic adhesives which have a viscosity of less than two million centipoises at 175° C., thus permitting them to flow quickly under moderate pressure at useful working temperatures to fill the openings of the microwave-blocking screen. Adhesives which do not remain permanently thermoplastic involve a number of problems which render them unsuitable for the present invention. For example, they generally require careful mixing with a hardening agent before use, and the mixture tends to advance in viscosity and hence have varying application characteristics depending upon the time elapsed since mixing.

The novel microwave oven window is readily assembled by economical techniques suitable for large-scale manufacture. For example, flexible plastic film and microwave-blocking screen may be drawn from rolls into apparatus for coating thermoplastic adhesive through the screen onto the plastic film to substantially fill the openings and cover both sides of the screen. The resultant composite is wound up with a disposable low-adhesion liner into roll form. Subsequently, the composite is drawn with a series of glass panels through a conventional squeeze-roll laminator which bonds the thermoplastic adhesive coating to the glass, after which the composite is trimmed to the size of the glass panels, thus removing any adhesive which has been squeezed out beyond the edges of the glass.

Another technique employs glass panels onto which microwave-blocking screens have been applied by silk-screening an alloy of silver. The panels are passed serially through a conventional squeeze-roll laminator with a roll of adhesive-coated plastic film. The laminator squeezes the adhesive into the openings of the screen. Then the adhesive-coated plastic film is trimmed to the size of the glass panels. In any such technique, it is preferred that the thermoplastic adhesive be a pressure-sensitive adhesive so that no heat need be applied to bond the adhesive to the glass panel. Even when using a pressure-sensitive adhesive, it may be desirable to apply heat in the laminating step, both to provide faster rates of production and to insure that the product windows are substantially void-free.

The present invention can utilize any metal screen that has microwave-blocking properties. A metal screen applied by silk-screening may have a thickness of only about 0.05 mm whereas screens of wire mesh or perforated metal may be as thick as about 0.75 mm, as is known in the art.

THE DRAWING

Figure 1:
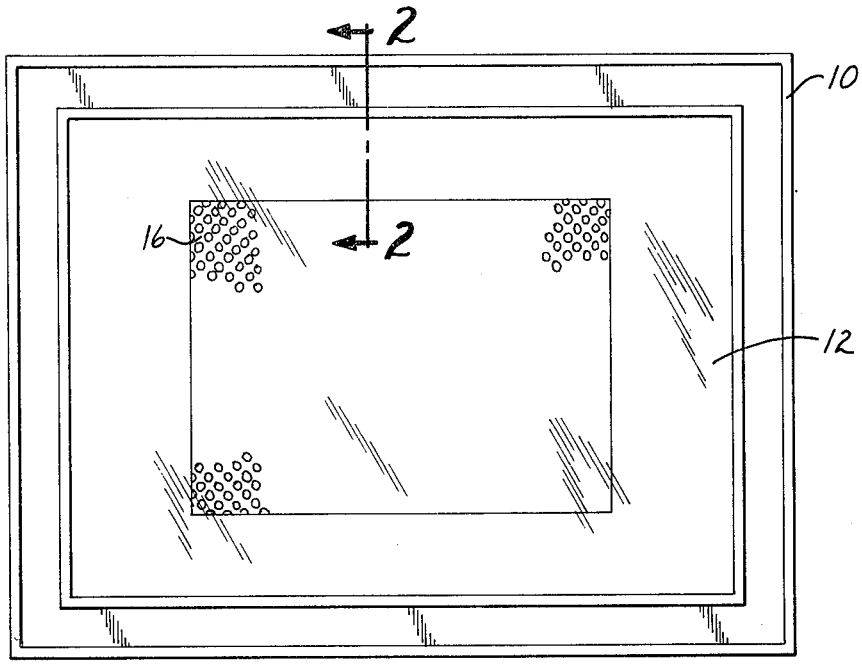
FIG. 1 is a schematic elevation of a microwave oven door including a window embodying the invention.
Figure 2:
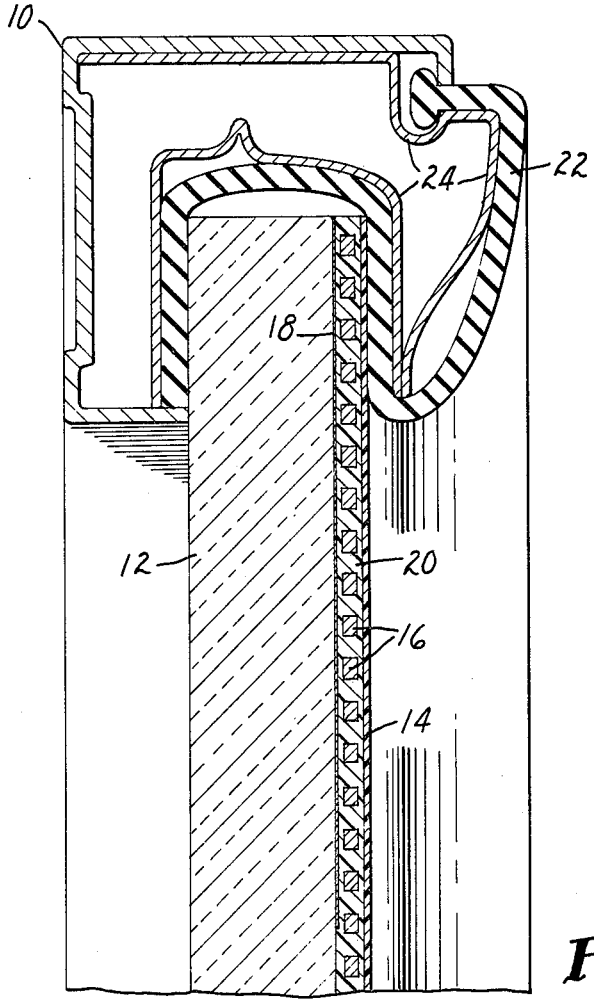
FIG. 2 is an enlarged cross section along line 2—2 of FIG. 1.

The illustrated door comprises a metal frame 10 for a pair of transparent panels 12 and 14 and a coextensive metal screen 16 between the panels. The exterior panel 12 may be heat-tempered plate glass, and the interior panel 14 may be a thin flexible plastic film. The interior surface of the exterior panel 12 has an optical frame 18 consisting of a very thin opaque coating which may be a layer of ink of a thickness just sufficient to render it opaque. The openings of the metal screen 16 are completely filled with transparent thermoplastic adhesive 20 which forms a continuous bond over substantially the entire areas of both the panel 12 (including its coating 18) and the panel 14. Although desirable, it is not necessary that the adhesive 20 be continuous in areas adjacent the solid portions of the screen 16 as long as it completely covers those areas of the panels 12 and 14 which are adjacent the openings of the screen. A microwave-blocking gasket assembly retained between the metal frame 10 and the interior panel 14 provides a microwave-and heat blocking seal to the body of the oven (not shown) when the door is closed. The gasket assembly consists of a rubbery member 22 consisting of plasticized polyvinyl chloride highly filled with conductive carbon particles and a structural member 24 consisting of thin spring steel.

The thickness of the interior panel 14 may be 0.1 mm, and the thickness of the thermoplastic adhesive 20 between the screen 16 and the interior panel 14 may be 0.05 mm. This provides a microwave-transmitting path only 0.15 mm in thickness between the microwave-blocking gasket 22 and screen 16, thus keeping microwave leakage to a very low level around the screen 16.

Figure 3:
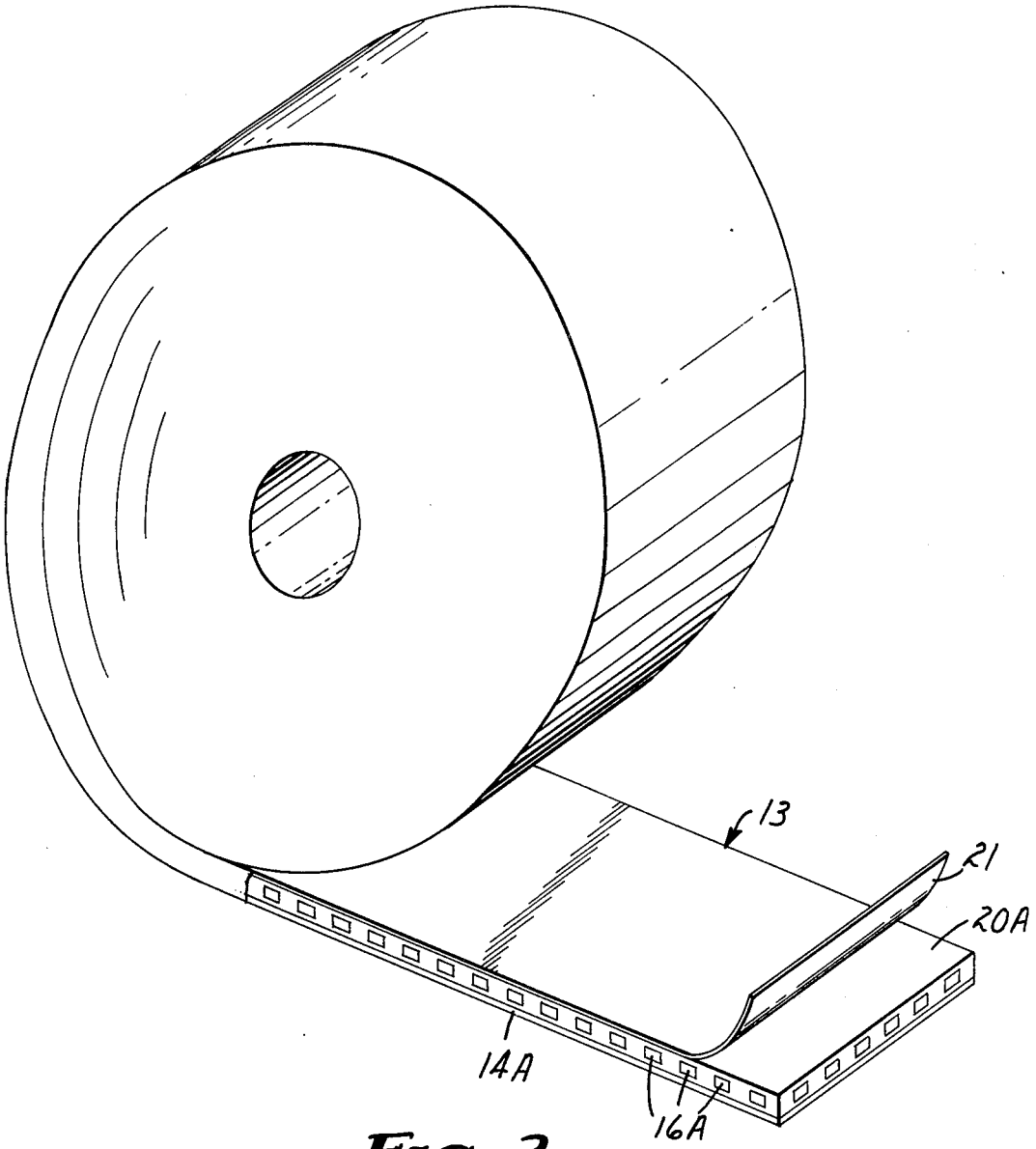
FIG. 3 is an enlarged schematic perspective of a composite useful for making the window shown in FIGS. 1 and 2.

FIG. 3 schematically shows a composite 13 useful for making the illustrated window which has been wound up into roll form for convenience. The composite includes a thin flexible plastic film 14A and a metal screen 16A embedded in an adhesive layer 20A. During manufacture, the plastic film 14A would normally be somewhat wider than the screen 16A, but before windup, both sides would be trimmed to make the two coextensive as illustrated. In any event, the screen would not extend beyond the edges of the film. Before adhering a piece cut to fit the exterior panel 12, the low-adhesion liner 21 would be peeled away as shown.

In the examples, parts are by weight.

EXAMPLE 1

A microwave oven window as illustrated in the drawing (except that screen 16 was wire mesh) was constructed using as the adhesive 20 a mixture of 100 parts of an acrylic pressure-sensitive adhesive and 20 parts of a terpene tackifier (Foral" 85). The acrylic adhesive was a copolymer of 94.5 parts of isooctylacrylate and 5.5 parts of acrylamide. The viscosity of the adhesive mixture was 29,000 cps at 175° C. (Brookfield spindle No. 28, 10 rpm). The interior panel 14 was biaxially-oriented polyethylene terephthalate film 0.1 mm in thickness bearing a thin abrasion-resistant thermoset resin coating, namely, a crosslinked epoxy silane coating. The screen 16 was 0.675 mm in thickness.

While the film and screen were drawn through a slot die coater, the adhesive was hot-melt coated through the screen onto the uncoated face of the film. The temperature of the melt tank was about 175°-180° C. The overall thickness of the adhesive was 0.825 mm, thus averaging 0.075 mm in thickness at the sides of the screen. Even if the screen reached a surface of the adhesive at some points, the maximum distance from the screen to the outer surface of the flexible film would not exceed 0.25 mm. A low-adhesion liner was immediately laid against the adhesive surface and the composite was wound upon itself for storage.

Subsequently, the liner was removed, and the adhesive was laid against the exterior transparent panel 12 (heat tempered glass) at room temperature, and a strong bond was made using a hard rubber roller by hand against the polyethylene terephthalate film. The film was then trimmed to the size of the screen and glass panel.

EXAMPLE 2

One part of the adhesive mixture of Example 1 was dissolved in one part of a 9:10:31 mixture of toluene, methanol and heptane. This was coated onto biaxially-oriented polyethylene terephthalate film of 0.1 mm thickness using a coating knife at a clearance of 1.5 mm. After drying in an air-circulating oven and cooling to room temperature, the dried adhesive thickness was 0.5 mm.

While the adhesive-coated film lay on a hot plate at 150° C., a microwave-blocking screen as in Example 1 was laid over the adhesive and in turn covered by a silicone-release-coated paper. Using a hard rubber roller under hand pressure against the paper, the screen was buried in the adhesive. The total thickness of the adhesive at this point was 0.75 mm. After removing the release paper, the exposed adhesive was laid against a tempered glass panel, and the hard rubber roller was applied against the polyethylene terephthalate film, followed by trimming of the film to the size of the glass and screen.

EXAMPLE 3

A window was constructed as in Example 1 except by using as the adhesive a normally nontacky thermoplastic copolymer of vinyl acetate and ethylene ("Elvax" 150) having a viscosity at 175° C. of 550,000 cps (Brookfield spindle No. 28, 0.5 rpm). Also, the tempered glass panel was preheated to 160°–165° C. before the final laminating step. The thickness of the screen-containing adhesive was 0.775 mm.

Each of the microwave oven windows of the three examples appeared to be as transparent as an otherwise identical window having only air space around the screen. None showed any visual evidence of entrapped air. The windows of the examples even seemed to offer a somewhat wider angle of vision as compared to the tunnel-vision effect of the window having air space at the screen.

By excluding air, the screens of the windows of the examples should be much more resistant to corrosion than would be a screen surrounded by air.

We claim:

1. A composite useful for making microwave oven windows, said composite comprising:

a flexible transparent film having a thickness not exceeding 0.25 mm, a microwave-blocking screen which does not extend beyond the film, a transparent thermoplastic adhesive which has zero creep at 65° C., remains transparent after prolonged exposure to heat, light and microwave radiation, has a viscosity of less than two million centipoises at 175° C., and substantially fills the openings and covers both sides of the screen to a thickness of 0.01 to 0.2 mm greater than the thickness of the screen, and a disposable low-adhesion liner covering the adhesive.

2. A composite as defined in claim 1 wherein the adhesive is a pressure-sensitive adhesive which will bond at room temperature to a transparent panel when the composite is used to make a microwave oven window.

3. A composite as defined in claim 1 wherein the transparent film is a biaxially-oriented polyester film having a thickness of at least 0.02 mm.

4. A composite as defined in claim 1 wherein the distance from the screen to the outer surface of the flexible film does not exceed 0.25 mm.

5. In a microwave oven window comprising a metal frame and a pair of transparent panels adhesively bonded to a microwave-blocking screen which is coextensive with the panels, the improvement comprising:

a transparent, thermoplastic adhesive which has zero creep at 65° C., remains transparent after prolonged exposure to heat, light and microwave radiation, has a viscosity of less than two million centipoises at 175° C., and substantially completely fills the space between the panels including the openings in the screen so that the window is substantially void-free and hence transparent except to the extent of the masking effect of the screen, the space between the two transparent panels which is filled by said thermoplastic adhesive is 0.01 to 0.2 mm greater than the thickness of the screen, the thickness of the interior of the two panels does not exceed 0.25 mm, and the thinness of the interior panel plus adjacent adhesive constricts the microwave-transmitting path therethrough to minimize microwave leakage.

6. In a microwave oven window as defined in claim 5, the further improvement comprising: the adhesive is a pressure-sensitive adhesive.

7. In a microwave oven window as defined in claim 6, the further improvement comprising: the adhesive is an acrylic pressure-sensitive adhesive.

8. In a microwave oven window as defined in claim 5, the further improvement comprising: the interior transparent panel is a thin biaxially-oriented polyester film.

* * * * *